US009777892B1

(12) United States Patent
Rowell

(10) Patent No.: US 9,777,892 B1
(45) Date of Patent: Oct. 3, 2017

(54) TUBE LIGHT SYSTEM AND METHOD OF MANUFACTURE THEREOF

(71) Applicant: Michael Rowell, Holbrook, MA (US)

(72) Inventor: Michael Rowell, Holbrook, MA (US)

( * ) Notice: Subject to any disclaimer, the term of this patent is extended or adjusted under 35 U.S.C. 154(b) by 29 days.

(21) Appl. No.: 14/803,366

(22) Filed: Jul. 20, 2015

Related U.S. Application Data

(60) Provisional application No. 62/027,483, filed on Jul. 22, 2014.

(51) Int. Cl.

| | |
|---|---|
| ***F21V 21/00*** | (2006.01) |
| ***F21K 99/00*** | (2016.01) |
| ***F21V 23/00*** | (2015.01) |
| ***F21V 23/06*** | (2006.01) |
| ***F21V 19/00*** | (2006.01) |
| ***F21K 9/90*** | (2016.01) |
| *F21W 131/109* | (2006.01) |
| *F21Y 103/00* | (2016.01) |

(52) U.S. Cl.
CPC ..... *F21K 9/175* (2013.01); *F21K 9/90* (2013.01); *F21V 19/0035* (2013.01); *F21V 23/002* (2013.01); *F21V 23/06* (2013.01); *F21W 2131/109* (2013.01); *F21Y 2103/003* (2013.01)

(58) Field of Classification Search
CPC ..... F21K 9/175; F21K 9/90; F21V 19/0035; F21V 23/002; F21V 23/06
See application file for complete search history.

(56) References Cited

U.S. PATENT DOCUMENTS

| | | | | |
|---|---|---|---|---|
| 6,882,118 | B2 * | 4/2005 | Kobayashi | H05B 41/2806 315/209 R |
| 7,021,809 | B2 * | 4/2006 | Iwasa | F21S 4/26 362/23.01 |
| 7,794,107 | B2 * | 9/2010 | Schoen | H01H 9/161 200/317 |
| 8,113,696 | B2 | 2/2012 | Striebel et al. | |
| 2007/0087619 | A1 * | 4/2007 | Nall | F21V 21/002 439/417 |
| 2007/0274067 | A1 * | 11/2007 | Sloan | F21V 15/015 362/219 |
| 2010/0201239 | A1 * | 8/2010 | Mostoller | F21S 8/031 313/1 |
| 2014/0376231 | A1 * | 12/2014 | Cox, Jr. | F21V 29/70 362/294 |

* cited by examiner

*Primary Examiner* — Anabel Ton
(74) *Attorney, Agent, or Firm* — Burns & Levinson LLP; Jacob N. Erlich; Marlo Schepper Grolnic

(57) ABSTRACT

A lighting system having a tubular, translucent housing including a light source disposed within the a recess of the housing. The light source includes one or more light-emitting elements on one or both sides. The lighting system is sized to fit within a receiving member, which may be a portion of a landscape structure or may be a stand-alone unit. Adjustment of the orientation of the housing relative to the receiving member changes the direction of light emitted by the light-emitting elements.

19 Claims, 8 Drawing Sheets

TUBE LIGHT SYSTEM AND METHOD OF MANUFACTURE THEREOF

CROSS REFERENCE TO RELATED APPLICATIONS

This application claims priority to and benefit of U.S. Provisional Patent Application No. 62/027,483 filed Jul. 22, 2014 and entitled UNIVERSAL TUBE LIGHT SYSTEM, the contents of which are incorporated by reference herein in their entirety and for all purposes.

BACKGROUND

Landscape edging (also referred to as "lawn edging" or "garden edging") exists to define borders between landscape areas, such as a lawn and a mulched garden bed. Landscape edging can be metal, plastic, wood, brick or a number of other materials, so long as it gives the look of a clean edge. Many people prefer the finished look that a clean edge lends to a landscape design. Landscape edging also provides functional benefits such as: 1) containing lawn grasses, which spread via stolons, so that grass does not start growing in planting beds; and 2) containing mulch in a planting bed, preventing it from spilling out. Landscape edging generally comes in long rectangular sections with a "lip" formed by a partially hollow top to strengthen the portion of the edging above ground and define a border. The bottom side is buried at the border of two areas so that the landscape edging frames and separates the two areas. Illumination of lawn and shrubbery adds safety lighting at night and is aesthetically pleasing.

SUMMARY

Currently, conventional landscape lighting systems are obtrusive and do not have the ability to direct light in a specific direction near a target area in a subtle way. Stake lights, in particular, are very noticeable, suffer from maximum exposure to the elements, and are not suitable to direct light into a specific direction.

Described herein is a tube light system that illuminates adjacent walkways for safety and visibility, and addresses problems and shortcomings of prior light systems. The embodiments described herein may be incorporated into landscape edging during the manufacturing process or may be retro-fitted into existing landscape edging to direct light in a subtle way close to the ground. Additionally, embodiments of the present disclosure allow the tube light system to be secured in such a way as not to depend on the tolerances of the landscape edging to hold it together.

In one example, the tube light system includes an elongated, tubular housing extending between a first end and a second end, the housing having a closed recess connecting the first and second ends and sized to fit within a receiving member, and a light source fixed in the recess of the housing, the light source having a first surface and a second surface opposite the first surface, the light source including one or more light-emitting elements on any of the first and second surfaces. The one or more light-emitting elements are completely enclosed within the housing, and adjusting the orientation of the housing relative to the receiving member changes the direction of light emitted by the at least one light-emitting element.

In another example, a lighting assembly may include the tube light system described above fitted within a receiving member.

In yet another example, a method of manufacturing a lighting assembly may include: 1) constructing two substantially mirror sections of an elongated, tubular housing, the housing having a closed recess connecting first and second ends of the housing and sized to fit within a receiving member, 2) constructing a light source, the light source including at least one light-emitting element, 3) disposing the light source within one of the two substantially mirror sections of the housing, 4) fixedly mating the other of the two substantially mirror sections of the housing to the one of the two substantially mirror sections, so that the light source is fixedly disposed within the closed recess, 5) vertically cutting a receiving member to create an opening, and 6) disposing the housing within the receiving member such that the light source emits light through the opening of the receiving member.

The tube light system of this disclosure is durable and maintenance free, and can easily be replaced as an element of a landscape lighting system if it ceases to function properly. The tube light system of the current disclosure has few moving parts and is easy to install. It may also provide a compact and pleasing appearance that blends into the landscape, without being too obvious during the daylight hours.

BRIEF DESCRIPTION OF THE DRAWINGS

The foregoing and other objects, features and advantages will be apparent from the following more particular description of the embodiments, as illustrated in the accompanying drawings in which like reference characters refer to the same parts throughout the different views. The drawings are not necessarily to scale, emphasis instead being placed upon illustrating the principles of the embodiments.

DETAILED DESCRIPTION

In the description that follows, features that are described and/or illustrated with respect to one embodiment may be used in the same way or in a similar way in one or more other embodiments and/or in combination with or instead of the features of the other embodiments.

The terms "comprise," "include," and/or plural forms of each are open ended and include the listed parts and can include additional parts that are not listed. "And/or" is open ended and includes one or more of the listed parts and combinations of the listed parts.

Figure 1A:
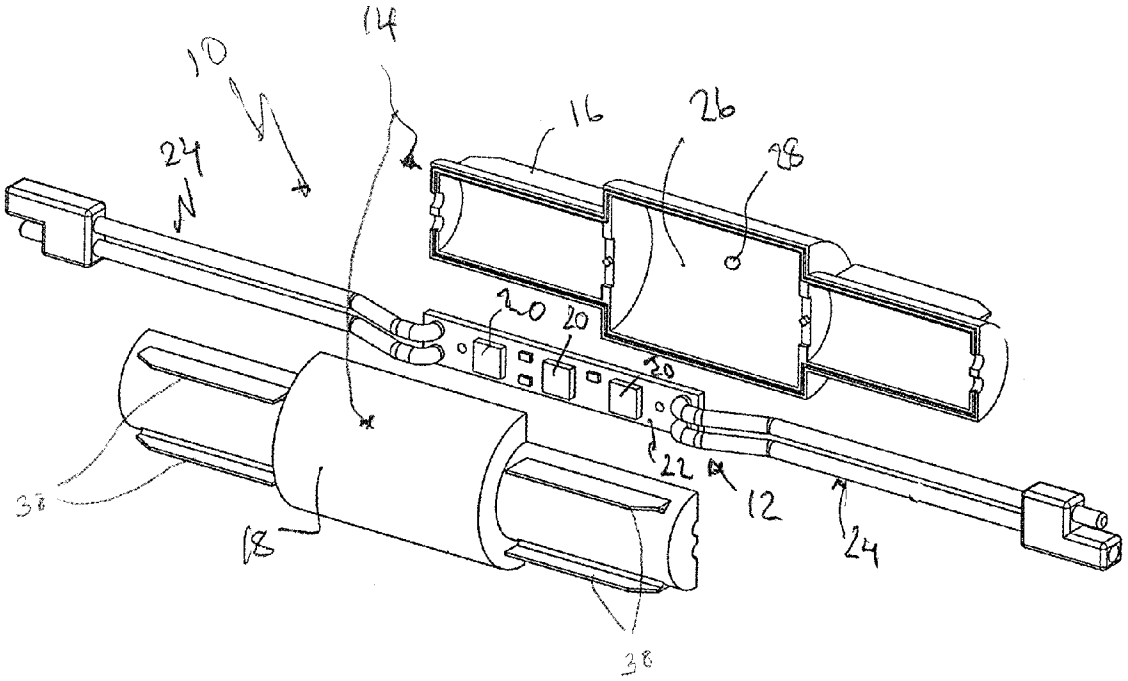
FIGS. 1*a-b* is a pictorial illustration of one embodiment of the present disclosure, shown in an exploded view.

Turning now to FIG. 1*a*, the tube light system 10 of the present disclosure may include a light source 12 disposed in an elongated, tubular housing 14. The housing 14 of the tube light system 10 may include two substantially mirror half sections 16 and 18 that are preferably injection molded plastic, but can be made from other material, or extruded, and could be formed as identical parts. One or both half sections 16, 18 may be translucent or otherwise manufactured using an optically clear plastic. A length of the housing 14 may be about 5.5 inches, although the length can vary. An outer surface of the housing 14 may also incorporate one or more deflectable friction members 38, such as preload pads or fins, the purpose of which will be described below.

Figure 1B:
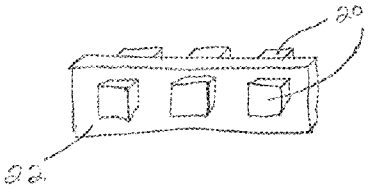

The housing 14 may contain a suitable recess 26 between a first and second end of the housing 14 for the light source 12 and other circuit components. The recess 26 may also provide a space for a manufactured seal such as an "o" ring and a male/female latch feature (not shown). A length of the recess can vary, but may be about 1.5 inches. The light source 12 of the tube light system 10 may have one or more light-emitting elements 20, such as a light-emitting diode (LED), mounted directly on a surface of a printed circuit board 22, which also carries at one or both of its ends at least one electrical element 24, such as a wire or a terminal (FIG. 3), which may be either stationary or movable, and may be waterproof. The tube light system 10 will therefore be able to be powered from either end. It is contemplated within this disclosure that the printed circuit board 22 can also accommodate further light-emitting elements 20 with light sources 12 oriented in the same or different directions, a rectifier, or a number of other electronic components. In a further embodiment, the printed circuit board 22 can be configured so that the light is directed on all sides like as a horizontal lamp. For example, the printed circuit boards 22 can be constructed so that the light-emitting elements 20 are mounted on opposite sides of the circuit board 22 (FIG. 1*b*), so that the light source is diffused from within the recess 26 of the housing 14 and emits light of near equal intensity in all directions from within the housing 14. The housing 14 may also have a suitable opening 28 through which protective substances, such as silicone or epoxy, can be injected, thus making the tube light assembly 10 highly resistant to water, dirt, sunlight and damage.

Figure 2:
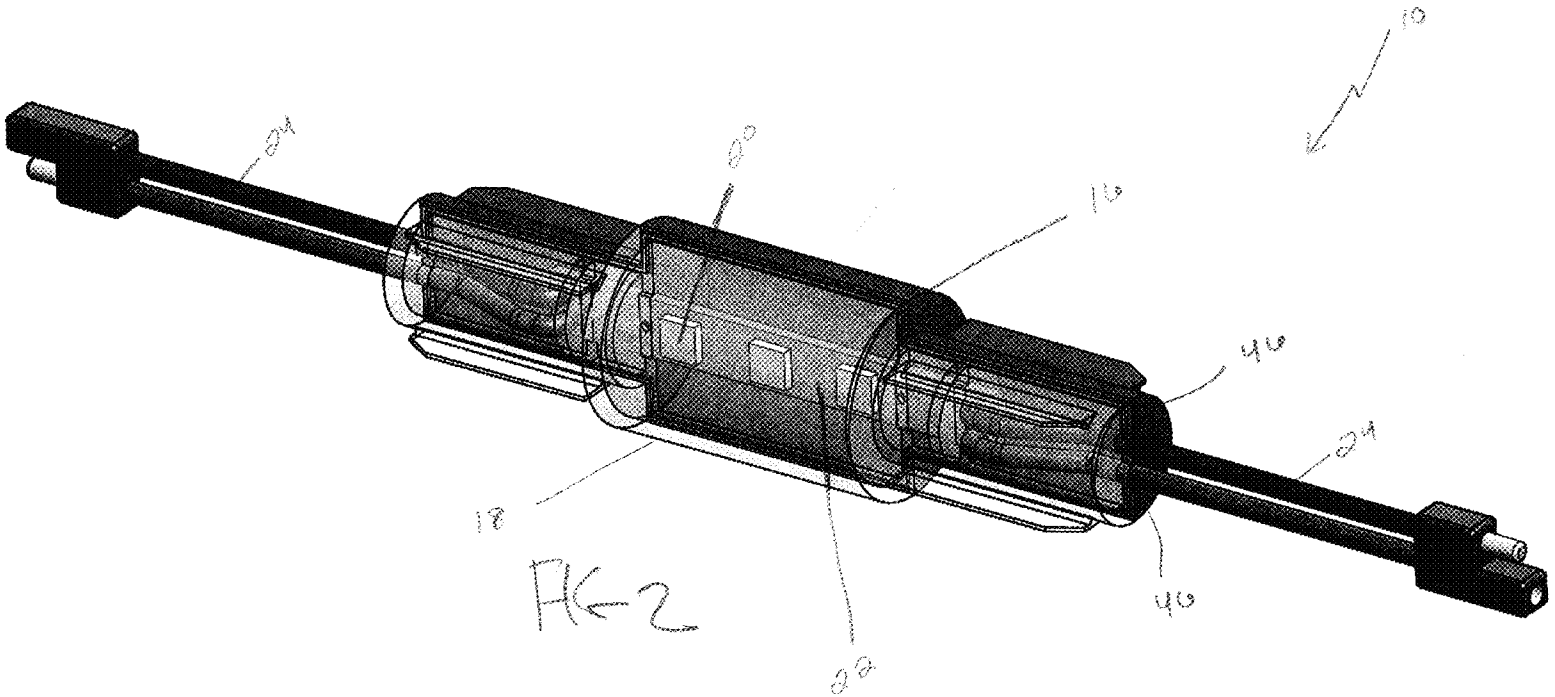
FIG. 2 is another pictorial illustration of one embodiment of the present disclosure, shown in an assembled view.
Figure 3:
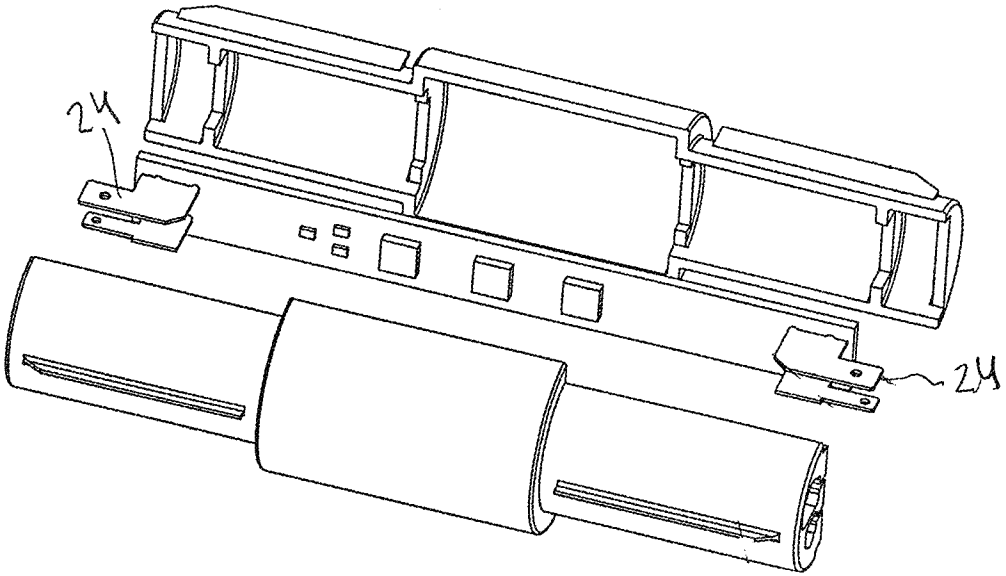
FIGS. 3-8 are other pictorial illustrations of embodiments of the present disclosure, including the tube light assembly contained in landscape edgings.

FIG. 2 shows the tube light system 10 of FIG. 1*a* in an assembled state. After placing the printed circuit board 22 (including the light sources 20) into one section 16 or 18 of the elongated housing 14, the other section 16 or 18 of the housing 14 may then be affixed to the other section using epoxy, sealant, cement, or separate seal feature using a mechanical latch incorporated into the housing 14 first to capture and hold the printed circuit board 22 in position, and to provide appropriate protection and resistance to the entrance of water and other foreign elements. As seen in FIG. 2, when assembled, each end of the sections 16 and 18 together define openings 46 configured to allow portions of the one or more electrical element 24 to extend outside of the housing 14. As shown in FIG. 3, the at least one electrical element 24 may be a terminal.

Figure 4:
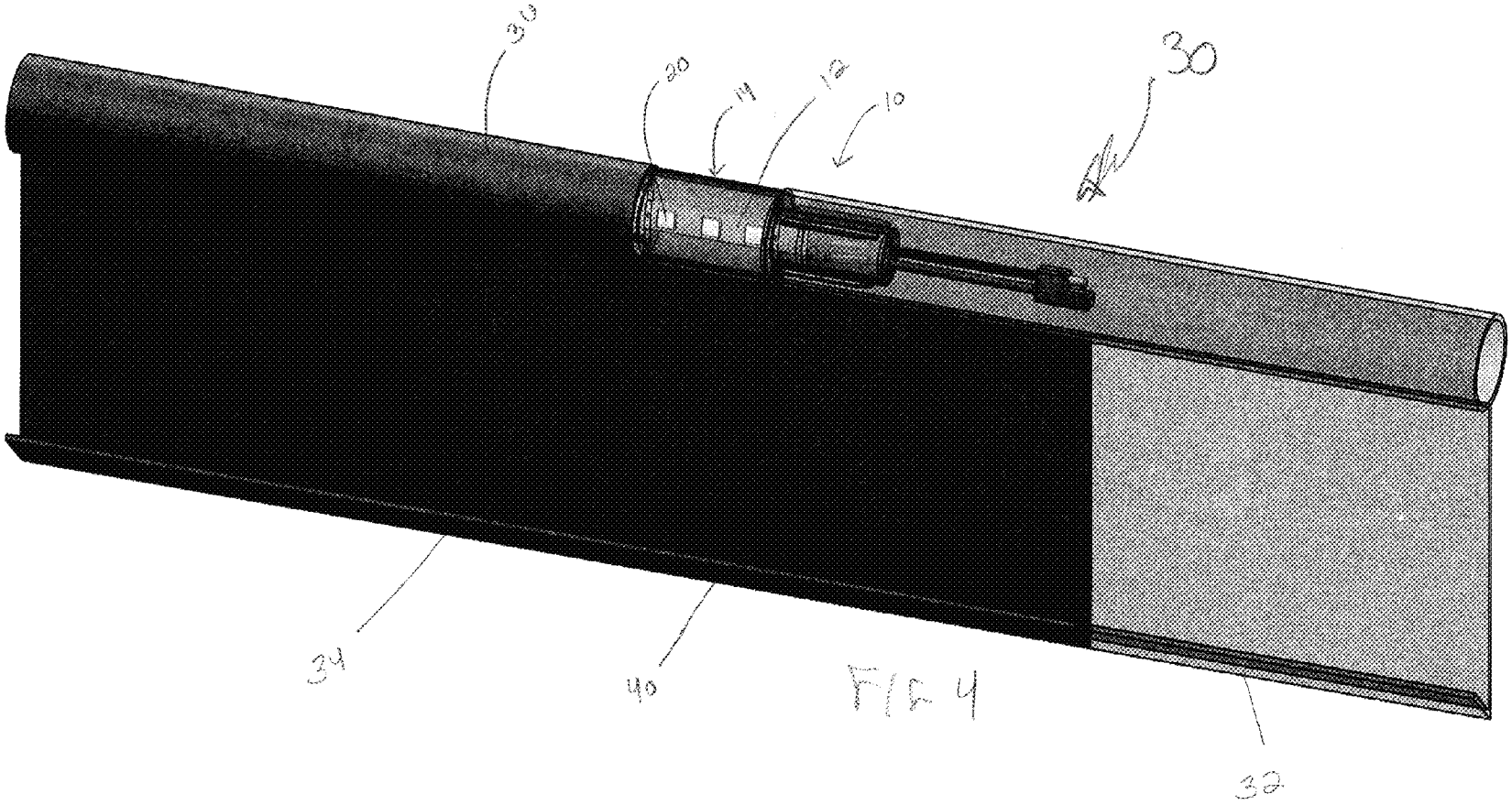

Turning now to FIG. 4, one advantage of the elongated housing 14 is that it is designed to fit inside an otherwise unused hollow top 36 (or similar member) of commercially available lawn or landscape edgings 30. Since not all landscape edgings 30 have identical sizes, the tube light system 10 allows a variation of shapes and sizes of the elongated housing 14, as well as variation in the size of the assembled light tube assembly 10. For example, the size and shape of the assembled tube light system 10 may be selected to fit into a hollow top 36 that has a diameter of about 0.68 inches to about 1.10 inches. Appropriate sections of the hollow top 36 may be cut vertically to allow light from the light source 12 to illuminate the surrounding area.

The elongated housing 14 may also serve to hold two adjoining landscape edging sections 32 and 34 together, and can provide protection for electrical connections with further light fixtures or a power source (not shown). The tube light system 10 may also serve to hold together two adjoining sections 32, 34 having a round or similar profile. The elongated housing 14 could alternatively be incorporated into one or more plates or other fixtures (not shown) that join sections 32, 34 of the landscape edging 30. The elongated housing 14 permits the light source 12 to be redirected by changing its position in relation to the hollow top 36 (or similar member). Since the outside of the housing 14 fits inside the hollow top 36, the light source 12 can be rotated both up and down inside the hollow top 36, as further described below. It is therefore possible to precisely direct the light source 12 alongside a walkway on one side of the edging 30, and later to rotate the light source 12 to illuminate a landscape on the opposite side. In this way, the tube light system 10 maintains a low profile but provides directional light to needed areas. The landscape edging 30 may further include a spacer 40 between edging 32, 34 to maintain a continuous barrier.

To rotate the elongated housing 14 in relation to the hollow top 36 of the edging 30, one need only to grasp the exposed section of housing 14 located outside of the edging 30 and, using a hand or a suitable tool, such as a pair of pliers, rotate the housing 14 relative to the hollow top 36 so that the light source 12 is properly directed and illuminating the desired location. Friction force is created by inserting the assembled sections 16, 18 of housing 14 that contain friction fins 38 (FIG. 1) into the hollow top 36 of the edging 30. The friction members 38 deflect upon insertion into the hollow edging top 36 depending on the internal diameter and wall thickness of the hollow top 36. It is the deflection of the friction members 38 along with the deformation of the inside of the hollow top 36, or a combination of both, that results with a suitable friction force which maintains the tube light system 10 in its desired position after it is moved.

Figure 5A:
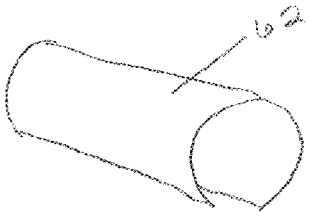
Figure 5B:
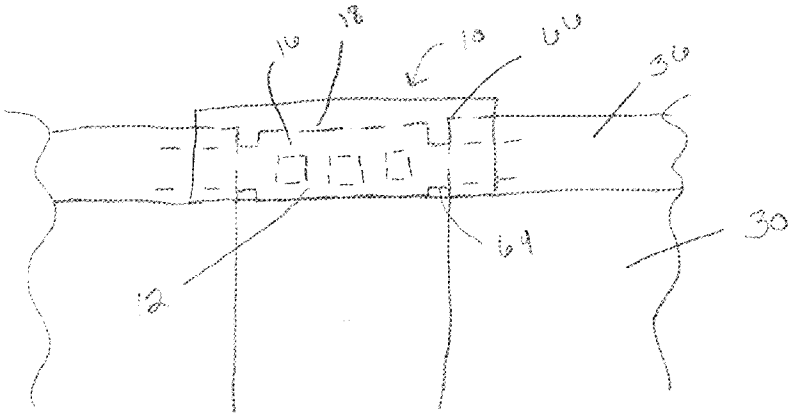

As shown in FIGS. 5*a-b*, one or more separate, translucent covers 62 of various colors and light transmittance can be removably installed (for example, by a snap fit) over the hollow top 36 of the edging 30 to partially encapsulate the half sections 16, 18, as well as some portion of each end of the tube light system 10. This feature advantageously allows for different configurations of both color and light transmittance emanating from the tube light system 10 and also conceals any spaces 64 between the light source 12 and the edging 30 due to natural expansion and contraction of the material. The cover 62 may extend about 0.75 inches or more to each side of the light source 12 to cover the joint 66 between the light source 12 and edging 30. The covers 62 could be made in white or in a variety of translucent colors, including red and blue. In this example, one or both of the half sections 16, 18 could be made from clear polycarbonate and the cover 62 made from transparent polycarbonate. It is contemplated by this disclosure that the cover 62 may be made from optically clear polycarbonate but configured so that different colored lenses could be installed on or removed from the cover 62 without the need to remove the cover 62. It is also contemplated by this disclosure that the covers 62 may be manufactured with the light source 12 fixedly incorporated therein.

Figure 6:
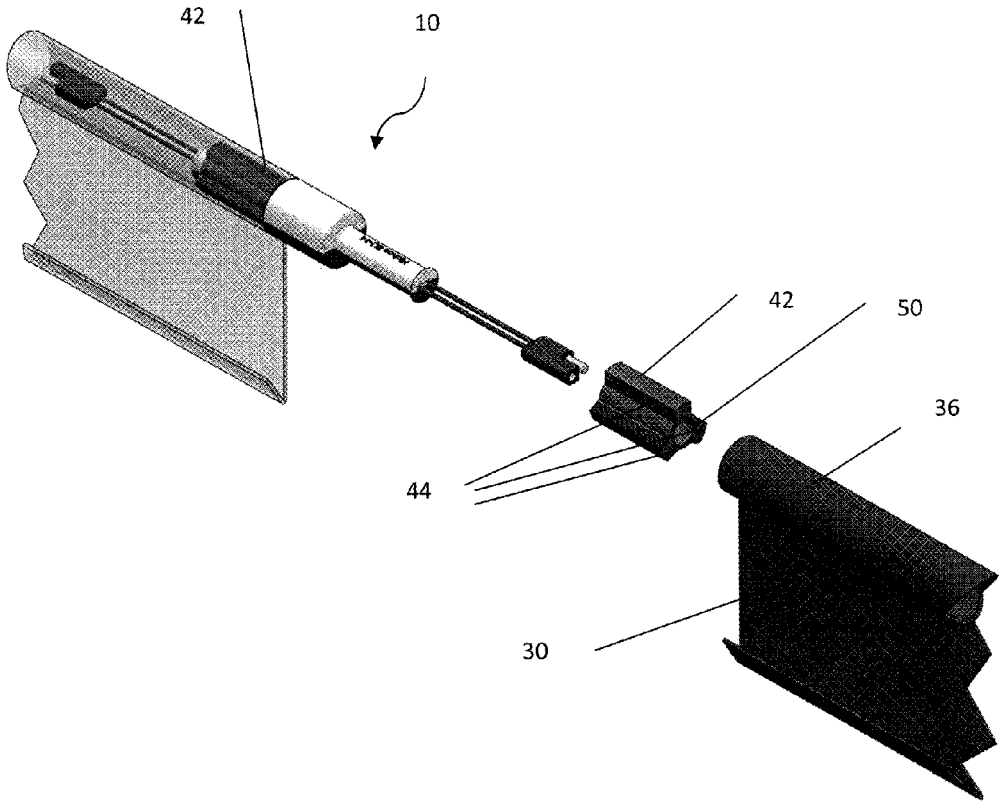

As shown in FIG. 6, the tube light system 10 may also include one or more hollow insulation sleeves 42, which may be made from foam or another suitable material that is capable of being cut or trimmed. The sleeves 42 may include one or more legs 44. The hollow core 50 of the sleeve 42 is sized to fit over an end portion of the housing 14. By trimming at least one of the one or more legs 44 to accommodate the variability in size and shape of the hollow top 36 of the landscape edging 30, a snug fit may be obtained within the hollow top 36.

Figure 7:
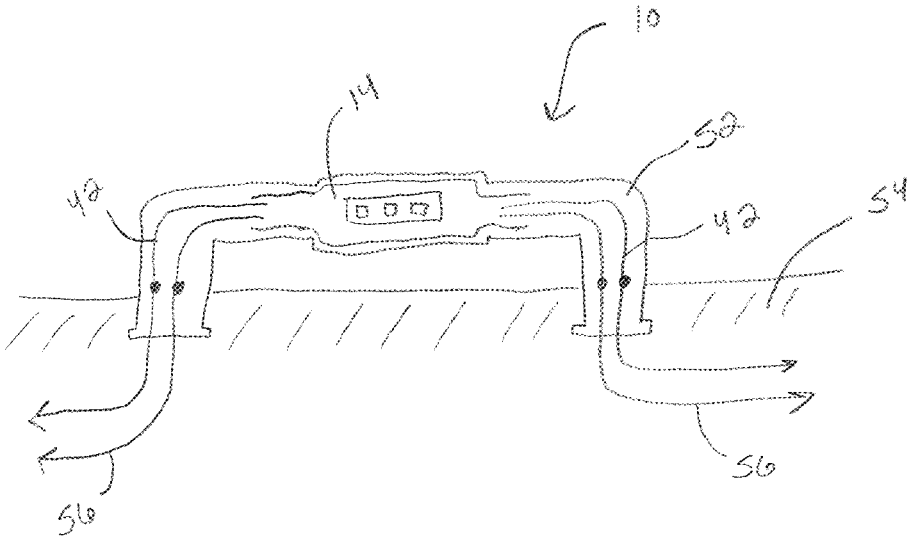

In a further embodiment, shown in FIG. 7, the tube light system 10 can be installed as a stand alone system which does not require and depend upon the hollow top 36 of the landscape edging 30. The housing 14 of the tube light system 10 may be encased in an appropriately sized stand-alone tube 52, which may be made of high or low density polyethylene, polycarbonate, acrylic, polyvinyl chloride, or other similar material. A portion of the tube 52, carrying electrical elements 42, would extend below the landscape 54 and be powered by a connection to direct burial landscape wire 56 connecting the tube light system 10 to a power source.

Figure 8:
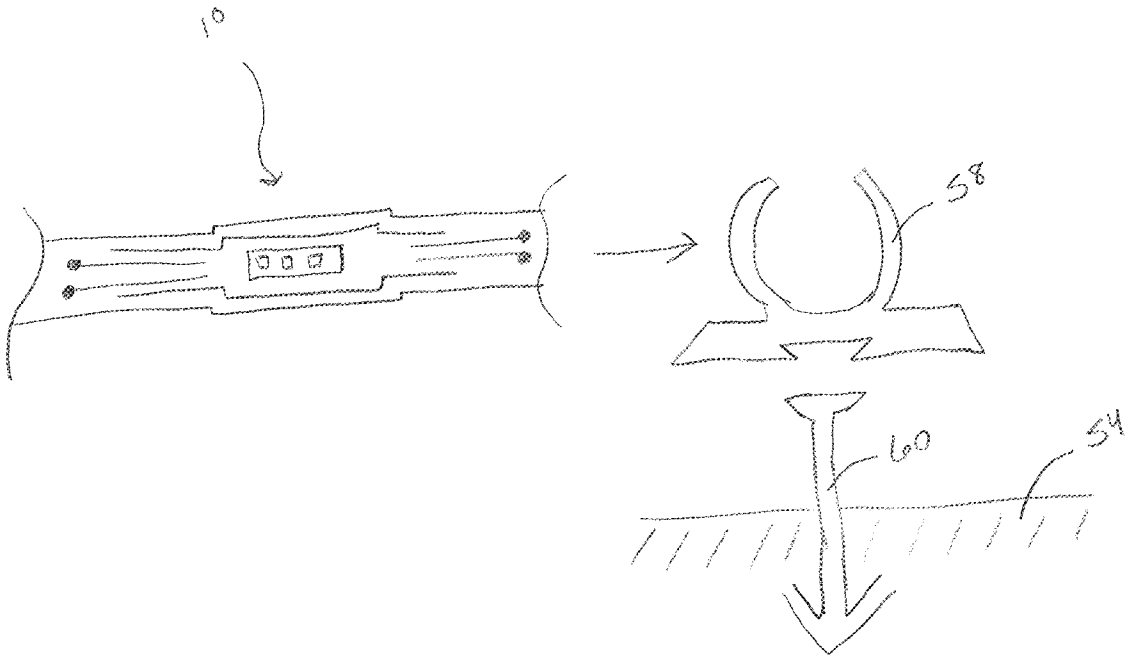

In another embodiment, shown in FIG. 8, the stand-alone tube light system 10 of FIG. 7 can be attached or affixed to the landscape 54, as well as to timber, brick, cement, or the like, using one or more snap clips 58 that partially encircle and hold the tube light system 10 in position. The snap clips 58 may be made of high or low density polyethylene, polycarbonate, acrylic, polyvinyl chloride, or other similar material, and may be held in place using a stake or screw 60 attached to the bottom side of the snap clip 58 via a dovetail cutout or similar feature. Like the embodiment of FIG. 7, this embodiment also eliminates the effects from expansion and contraction between the edging 30 and the tube light system 10.

It is contemplated by this disclosure that the hollow top 36 may be installed as a separate unit to commercially available landscape edging 30. While the hollow top 36 and the landscape edging 30 are normally extruded as one piece, if designed with specific features, the hollow top 36 and edging 30 could be adjoined in the field. In this example, a copper ribbon could be extruded as part of the hollow top 36 and covered by a membrane which may be polyethylene. The tube light system 10 would incorporate an adapter or other means to pierce through the membrane, resulting in contact to the electrical conductors, providing power for the tube light system 10. The circuit is then continued through the printed circuit board 22 of the tube light system 10, feeding the adjacent section(s) of edging 30 or similar by the same method. This process can be repeated and is only limited by the capacity of the power supply, the capacity of the printed circuit board 22, or the capacity of the concealed conductors inside the hollow top 36.

It is also contemplated within this disclosure that the tube light system 10 may serve as a modular "building block" which can be incorporated with other tube light systems 10. Each time a tube light system 10 is added, a connection with electrical wires is required. Commercially existing "connectors" that do not require wire ends to be stripped may be used for this purpose. One connector (not shown) may be placed into each side of the hollow end of top 36 of the elongated housing 14, protected and invisible from the outside, and preferably a sufficient length of electrical wire is incorporated that allows the tube light system 10 to be easily removed and replaced later, if such replacement is ever required.

Although the present disclosure has been described with respect to various examples, it would be apparent to one of ordinary skill in the art that various other examples are possible, without departing from the spirit and scope as defined in the appended claims.

What is claimed is:

1. A lighting system, comprising:

a tubular housing having a longitudinal axis extending between a first end and a second end, the housing further comprising a closed recess connecting the first and second ends, the housing sized to fit within a receiving member, a diameter of the recess selected to be larger than a diameter of the housing;

a light source fixedly disposed within the recess such that a long axis of the light source extends along the longitudinal axis of the housing in direct communication with an interior of the housing, the light source having a first surface and a second surface opposite the first surface, the light source comprising one or more light-emitting elements disposed on any of the first and second surfaces;

wherein the one or more light-emitting elements are completely enclosed within the housing; and wherein adjusting the orientation of the housing relative to the receiving member changes the direction of light emitted by the at least one light-emitting element.

2. The lighting system of claim 1, wherein the housing is comprised of two substantially mirror half sections configured to fixedly mate together.

3. The lighting system of claim 2, wherein at least one of the mirror half sections is comprised of a translucent or optically clear material.

4. The lighting system of claim 1, wherein the light source is a printed circuit board.

5. The lighting system of claim 1, wherein the one or more light-emitting elements are LEDs.

6. The lighting system of claim 1, wherein the receiving member is a portion of a landscaping structure.

7. The lighting system of claim 1, wherein the receiving member is a stand-alone unit.

8. The lighting system of claim 1, wherein an outer surface of the housing comprises one or more deflectable friction members.

9. The lighting system of claim 1, wherein the light source further comprises at least one electrical element at least partially disposed in an end of the housing.

10. The lighting system of claim 9, wherein the at least one electrical element is a wire.

11. The lighting system of claim 9, wherein the at least one electrical element is a terminal.

12. The lighting system of claim 1, further comprising an insulation member covering one or both of the first and second ends of the housing.

13. The lighting system of claim 1, wherein an inner surface of the receiving member comprises electrically conductive elements.

14. A lighting assembly, comprising:

a lighting system comprising:

a tubular housing having a longitudinal axis extending between a first end and a second end, the housing further comprising a closed recess connecting the first and second ends, a diameter of the recess selected to be larger than a diameter of the housing, the housing sized to fit within a receiving member; a light source fixedly disposed in the recess such that a long axis of the light source extends along the longitudinal axis of the housing, the light source having a first surface and a second surface opposite the first surface, the light source comprising one or more light-emitting elements disposed on any of the first and second surfaces; wherein the one or more light-emitting elements are completely enclosed within the housing; and the receiving member.

15. The lighting assembly of claim 14, wherein the receiving member is a portion of a landscaping structure.

16. The lighting assembly of claim 14, wherein the receiving member is a stand-alone unit.

17. The lighting assembly of claim 14, further comprising one or more lighting systems electrically connected in series.

18. A method of manufacturing a lighting assembly, the method comprising:

constructing two substantially mirror sections of a tubular housing having a longitudinal axis extending between a first end and a second end, the housing comprising a closed recess connecting the first and second ends of the housing and sized to fit within a receiving member, a diameter of the recess selected to be larger than a diameter of the housing;

constructing a light source, the light source comprising at least one light-emitting element;

disposing the light source within one of the two substantially mirror sections such that a long axis of the light source extends along the longitudinal axis of the housing;

fixedly mating the other of the two substantially mirror sections of the housing to the one of the two substantially mirror sections, such that the light source is fixedly disposed within the closed recess;

vertically cutting a receiving member to create an opening; and disposing the housing within the receiving member such that the light source emits light through the opening of the receiving member.

19. The method of claim 18, further comprising electrically connecting the lighting assembly with one or more other lighting assemblies in series.

* * * * *